United States Patent [19]

Ayala

[11] Patent Number: 4,635,416

[45] Date of Patent: Jan. 13, 1987

[54] METAL CHANNEL APPARATUS AND METHOD FOR FORMING A STAIRWAY

[76] Inventor: Albert Ayala, 2105 N. Bullmoose, Chandler, Ariz. 85224

[21] Appl. No.: 769,366

[22] Filed: Aug. 26, 1985

[51] Int. Cl.[4] ..... E04G 13/06; E04F 11/12

[52] U.S. Cl. ..... 52/188; 182/93; 182/220

[58] Field of Search ..... 182/194, 220, 228; 52/182, 188, 191, 712, 713, 715, 655, 696, DIG. 6

[56] References Cited

U.S. PATENT DOCUMENTS

| | | | |
|---|---|---|---|
| 553,487 | 1/1896 | Godfrey | 182/194 |
| 1,582,017 | 4/1926 | Vetterlein | 182/220 |
| 2,021,457 | 11/1935 | Mackenzie . | |
| 2,518,745 | 8/1950 | Batelja | 182/220 |
| 2,593,683 | 4/1952 | Lyons . | |
| 3,196,997 | 7/1965 | Hager . | |
| 3,216,160 | 11/1965 | Best | 52/715 |
| 3,667,572 | 6/1972 | Anderson . | |
| 4,015,687 | 4/1977 | Dean . | |
| 4,422,270 | 12/1983 | Lapointe . | |
| 4,464,870 | 8/1984 | Crepeau . | |

FOREIGN PATENT DOCUMENTS

| | | | |
|---|---|---|---|
| 2309685 | 11/1976 | France | 52/191 |

*Primary Examiner*—Reinaldo P. Machado

*Attorney, Agent, or Firm*—Harry M. Weiss & Associates

[57] ABSTRACT

A series of highly economical metal channels each having a first and second side members extending vertically downward from a third horizontal member for accommodating thereto a step and a riser for rapidly, yet sturdily forming a stairway is disclosed. A plurality of quickly-installed attaching means for integrally coupling together a combination of a generally rectangular beam, metal channel, step and riser are used at various areas of said stairway in order to avoid thereto the time-consuming and expensive manner of providing a sawtooth-type stairway beam.

1 Claim, 4 Drawing Figures

METAL CHANNEL APPARATUS AND METHOD FOR FORMING A STAIRWAY

BACKGROUND OF THE INVENTION

1. Field of the Invention

This invention generally relates to a concept of using a series of metal channels in combination with a generally rectangular "horse" (i.e., a preferably wooden beam used for purposes of making stairway steps). Each metal channel has a first and second side member protruding therefrom a third side member therebetween said first and second side members. A plurality of metal channels are secured thereabove each of at least a pair of "horses" to permit therefrom a plurality of steps and risers to be secured thereto.

2. Description of the Relevant Art

There has been a substantial need for economically and rapidly constructing a stairway. A conventional manner is which a standard stairway is erected is by way of cutting a generally large plank in the saw-type configuration for providing therefrom a horizontal support for securing a step and a vertical support for securing a riser. Such a conventional method of cutting a plank is highly undesirable in that the cut material is wasted notwithstanding the wasted time and effort in forming the saw-type beam. Accordingly, improvements were devised whereby the "horse" remains in a form of an elongated rectangular beam at least one vertical and one horizontal support member protruding therefrom from a portion of said beam to distinctly support thereby a step and a riser (as disclosed, e.g., in U.S. Pat. No. 2,021,457 filed by M. T. MacKenzie on Dec. 7, 1932 and issued Nov. 19, 1935; U.S. Pat. No. 3,196,997 filed by E. M. Hager on Oct. 19, 1961 and issued July 27, 1965; and U.S. Pat. No. 4,464,870 filed by R. E. Crepeau on Oct. 25, 1982 and issued Aug. 14, 1984. However, protruding members extending from the beam, as taught by the above-mentioned patents are suitable only for attachment at the top surface of the "horse" thereby inadequate to fully support any side stresses experienced by the protruding devices. Similarly, in U.S. Pat. No. 3,667,572 filed by C. E. Anderson on Mar. 5, 1971 and issued June 6, 1972, a bracket support extending from the top surface of the "horse" to the front bottom surface of the step to permit the back portion of the step to be coupled to said top surface of the "horse" is disclosed. The C. E. Anderson patent, although simplistic, would be insufficient to support side stresses applied on the steps as well as significant compression and bending loads subsequently applied to each of the bracket supports.

More elaborate, yet cumbersome devices have been disclosed in an attempt to rid of the sawtooth-type "horse" (as illustrated in U.S. Pat. No. 4,015,687 filed by R. Dean on Jan. 8, 1976 and issued Apr. 5, 1977) or altogether rid of the "horse" (as, e.g., in U.S. Pat. No. 2,593,683 filed by G. W. Lyons on July 20, 1949 and issued Apr. 22, 1952; and U.S. Pat. No. 4,422,270 filed by L. Lapointe et al. on Jan. 19, 1982 and issued Dec. 27, 1983. In the Dean device, the step bracket acts as the riser which places significant reliance on said bracket to sustain the entire axial load encountered by the step which clearly presents a significant problem. In the elaborate prefabricated or self-supporting stairs taught by Lyons and Lapointe et al., respectively, the numerous attaching means require constant attention and maintenance, especially the need to frequently adjust and replace a misaligned or defective member which can be significantly cumbersome.

In the present invention, there is a metal channel having first and second generally vertical extending members integral from a generally horizontal third member sturdily coupled to a generally rectangular beam. The first and second members are integrally joined to opposing sides of said beam by a plurality of attaching means extending therefrom upper and front portions of said metal channel for integrally accommodating a step and riser, respectively, thereto. More particularly, at least one nail, preferably a toe nail, diagonally imbedded through the step and the beam for coupling thereto while a generally similar toe nail, functionally at a diagonal position, integrally connects the riser to the back portion of the step. Preferably, a self-tapping screw positioned at an axial downward direction couples the front portion of the step to the riser. If desired, a plurality of self-tapping screws may be used to integrally couple the step to the upper portion of the metal channel.

It is therefore an object of the present invention to provide a metal channel for integral coupling to a generally rectangular beam suitable for accommodating a step and riser to form a stairway.

It is another object of the present invention to provide a metal channel for simply forming a stairway suitable for sustaining stresses from all directions.

It is still another object of the present invention to provide a metal channel for sturdily forming a stairway which can be easily and economically produced, yet sturdy in construction and highly efficient in operation.

It is yet a further object of the present invention to provide a metal channel for sturdily forming a stairway which is constructed with extreme simplicity, embodying relatively simple parts, and therefore capable of being retailed for a low price, long-lasting in use, and extremely convenient to use.

SUMMARY OF THE INVENTION

The aforementioned and other objects of the present invention are accomplished by providing a highly economical metal channel having a first and second side members extending vertically downward from a third horizontal member for accommodating thereto a step and a riser for rapidly, yet sturdily forming a stairway. A plurality of quickly-installed attaching means for integrally coupling together a combination of a generally rectangular beam, metal channel, step and riser are used at various areas of said stairway in order to avoid thereto the time-consuming and expensive manner of providing a sawtooth-type stairway beam.

These and other features of the invention will be understood upon reading of the following description along with the drawings.

DESCRIPTION OF THE PREFERRED EMBODIMENT

Figure 1:
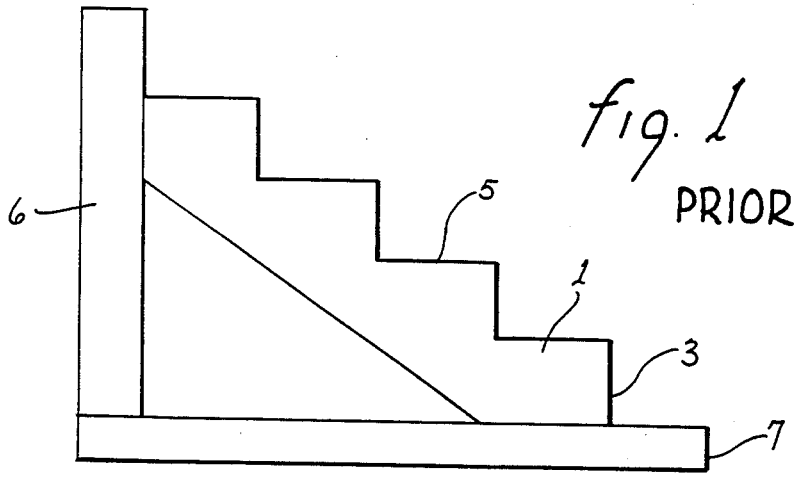
fig. 1 PRIOR ART
FIG. 1 is a side elevational view of a conventional sawtooth-type beam for accommodating thereto a plurality of steps and risers for forming a stairway.

FIG. 1 is a side elevational view of a conventional sawtooth-type beam 1 having configured therein a plurality of vertical portion 3 for integrally accommodating risers (not shown) and a plurality of horizontal portions 5 for integrally accommodating steps (not shown). As done in a standard manner, the sawtooth beam 1 is sturdily braced diagonally by a vertical frame member 6 at one end and a horizontal base frame member 7 at the opposite end.

Figure 2:
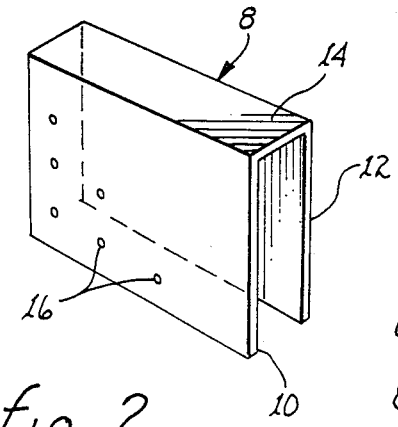
FIG. 2 is a perspective view of the preferred embodiments of a metal channel having a first and second members, with a plurality of apertures passing therethrough for accommodating a plurality of attaching means, protruding perpendicularly thereform a third member.

As illustrated in FIG. 2, a metal channel generally designated by reference numeral 8, of the present invention has first 10 and second 12 side members vertically protruding at a downward direction therefrom a third side member 14. The first 10 and second 12 side members are preferably perpendicularly integral to the third side member 14. The first side member 10, as well as to the second side member 12 (although not shown), have a plurality of apertures 16 passing therethrough for accommodating thereto attaching means 18 for integrally coupling said first 10 and second 12 side members onto a generally rectangular beam 20, as illustrated in FIG. 3.

Figure 3:
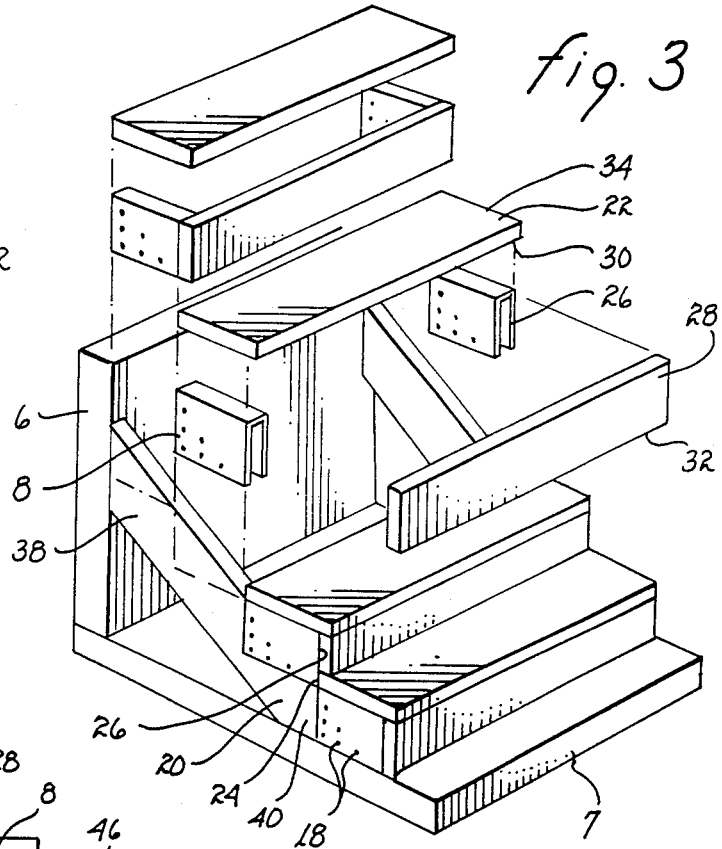
FIG. 3 is a perspective exploded view of the manner in which a plurality of the metal channels are used thereabove at least a pair of generally rectangular beams, including a plurality of attaching means for coupling steps and risers to form a stairway.

As shown in FIG. 3, a plurality of channels 8, made of metal, hard plastic or other strong, rigid and durable material are secured onto the upper portion of the beam 20 by a plurality of attachment means 18, preferably made of nails or the like. A step member 22 is mounted on the third side member 14 having the back end 24 of said step member 22 abutting the front surface 26 of the metal channel 8. A riser 28 abuts the uppermost front portion 30 of the step 22 thereabove, and a residual front surface 26 of the metal channel 8. Moreover, the bottom end 32 of the riser 28 abuts a back portion 34 of the step member 22.

As done in a standard manner, at least a pair of beams 20 diagonally connected between a vertical frame member 6, at a back end portion 38, and a horizontal base frame member 7, at an opposite front end portion 40 of the beam 20.

Figure 4:
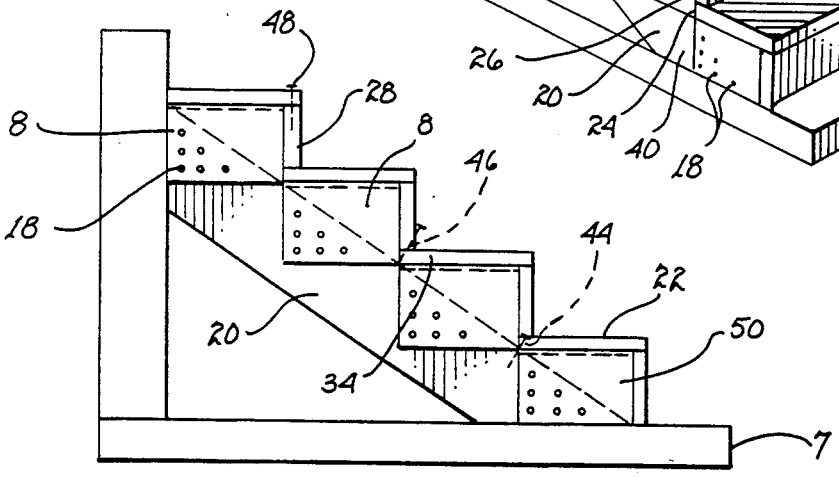
FIG. 4 is a side elevational view of a completely formed stairway incorporating thereto a plurality of the metal channels of the present invention.

The properly formed stairway which makes use of the plurality of metal channels 8 are secured by a plurality of nails 18, 44, 46, screws 48 and the like. As for example, the back portion 34 of the step member 22 is attached thereto the beam 20 by way of at least one first diagonally-imbedded nail, as illustrated in FIG. 4. Moreover, the riser 28 is integrally coupled to the back portion 34 of the step 22 by way of at least one second diagonally-imbedded nail 46, also preferably a toe nail, as further shown in FIG. 4. The uppermost front portion 30 of the step 22 is integrally coupled to the riser 28 by way of at least one screw 48, preferably a tapping screw. If desired, a plurality of screw attaching means (not shown) may be used for integrally attaching the step 22 to the metal channel 8. It is to be noted, that the attaching means, including the plurality of nails 18 44, 46, screws 48 and the like are utilized for assembling each combination of integrally connected step 22, riser 28, metal channel 8 to at least a pair of the beams 20.

It is to be further noted that a bottom metal channel 50 has a height relatively shorter than the rest of the plurality of metal channels 8 in order to thereby compensate for the absence of an abutting step 22 underneath the bottom metal channel 50 in order to compensate thereto the horizontal base frame member 7. Accordingly, the height of the bottom metal channel 50; i.e., the elevations of the first 10 and second 12 side members in addition to the width of the third side member 14, is equivalent to the height of the riser 28.

While the invention has been particularly shown and described in reference to preferred embodiments thereof, it will be understood by those skilled in the art that changes in form and details may be made without departing from the spirit and scope of the invention.

I claim:

1. A method for forming a stairway by using a series of metal channels, each having a generally u-shaped configuration, comprising the steps of:

diagonally coupling a rectangular beam onto a vertical brace member and a horizontal base member;

placing each of said metal channels thereabove a generally rectangular beam;

fastening each side of said u-shaped metal channel to each side of said rectangular beam;

placing a step thereabove the top portion of a horizontal side joining each of the pair of perpendicular extending sides of said generally u-shaped metal channel;

fastening said step onto said beam with a nail means;

placing a riser thereabove said step abutting the front portion of said metal channel;

fastening said riser onto said step with a nail means;

placing an upper step onto the upper end of said riser;

fastening said upper step onto said riser with a screw means; and thereafter integrally joining a bottom metal channel having a height smaller than the height of the series of said metal channel, said bottom metal channel has a height equivalent to the height of said riser.

* * * * *